US005494262A

United States Patent [19]

McLane et al.

[11] Patent Number: 5,494,262

[45] Date of Patent: Feb. 27, 1996

[54] METAL DELIVERY SYSTEM

[75] Inventors: Jack E. McLane; Robert R. Rader, both of Port Huron, Mich.

[73] Assignee: Wirtz Manufacturing Co., Inc., Port Huron, Mich.

[21] Appl. No.: 383,460

[22] Filed: Feb. 3, 1995

[51] Int. Cl.[6] ..... C21B 7/12

[52] U.S. Cl. ..... 266/45; 266/239

[58] Field of Search ..... 266/45, 239, 227; 415/121.2

[56] References Cited

U.S. PATENT DOCUMENTS

| | | | |
|---|---|---|---|
| 2,244,490 | 6/1941 | Doyen | 22/57 |
| 2,548,696 | 4/1951 | Barstow et al. | 318/482 |
| 3,058,432 | 10/1962 | Lamb | 266/239 |
| 3,210,811 | 10/1965 | Schneider | 22/37.2 |
| 3,292,473 | 12/1966 | Couzens et al. | 83/318 |
| 3,486,660 | 12/1969 | Heintz | 222/1 |
| 3,532,445 | 10/1970 | Scheffler, Jr. | 417/424 |
| 3,767,090 | 10/1973 | Sundberg et al. | 222/383 |
| 4,175,612 | 11/1979 | Baumert | 164/449 |
| 4,398,589 | 8/1983 | Eldred | 164/337 |
| 4,449,568 | 5/1984 | Narashimham | 164/453 |
| 4,828,460 | 5/1989 | Saito et al. | 417/50 |
| 4,860,820 | 8/1989 | Pereira | 164/157 |
| 4,928,933 | 5/1990 | Motomura | 266/237 |
| 5,053,076 | 1/1992 | Burany et al. | 75/699 |
| 5,078,572 | 1/1992 | Amra et al. | 415/121.2 |
| 5,084,094 | 1/1992 | Francois et al. | 266/227 |
| 5,178,203 | 1/1993 | Kuhn et al. | 164/147 |
| 5,271,521 | 12/1993 | Noss et al. | 222/1 |

*Primary Examiner*—Scott Kastler

*Attorney, Agent, or Firm*—Barnes, Kisselle, Raisch, Choate, Whittemore & Hulbert

[57] ABSTRACT

Apparatus for delivering molten metal such as lead to a receiver comprising a variable speed pump and a delivery pipe leading from the pump. The delivery pipe has an upwardly extending portion which leads to a discharge orifice from which molten metal may be discharged. A variable speed motor drives the pump. A controller causes the motor to drive the pump selectively at a first speed sufficient to raise molten metal and maintain it at a predetermined level in the upwardly extending portion of the delivery pump and at a second speed sufficient to force molten metal in the delivery pipe from the discharge orifice.

31 Claims, 3 Drawing Sheets

METAL DELIVERY SYSTEM

FIELD OF THE INVENTION

This invention relates generally to a metal delivery system, and more particularly to a system for delivering measured amounts of molten metal to a receiver such as a ladle or mold.

BACKGROUND OF THE INVENTION

One metal delivery system that has been used in the past requires a pump to be run continuously at a constant speed to pump molten metal to a dispensing valve. The dispensing valve is operated intermittently to deliver metered amounts of metal. Several problems arise in connection with this system, such as leakage, wear on the valve parts and metal solidifying in the distribution system.

Another system that has been used employs a variable speed pump to produce a continuous flow of metal to a ladle or mold. The pump which runs continuously speed is adjusted to pump a predetermined amount of metal during each pouring cycle. This system requires adjustment or set of the pump speed or of a metering valve each time the pouring cycle is changed. When the pouring cycle is stopped or interrupted, the pump must be stopped. This results in start-up problems, including metal solidifying in the system.

SUMMARY OF THE INVENTION

The system of the present invention has the advantage of dispensing accurate amounts of molten metal, such as lead, without leakage or wear and tear on valve parts, while eliminating start-up and cycle change problems. The system includes a motor for driving a pump at variable speeds. The pump is operated at one speed to maintain a predetermined level of metal in the delivery system, and then at a higher speed to force metal out through an orifice into a ladle or mold. To cut off the delivery of metal, the pump is rapidly decelerated back to the first speed. The duration of time of operation of the pump at the higher speed can be varied depending on the amount of metal desired to be dispensed. The pump speed is preferably decreased very rapidly to cut off the metal flow quickly.

Preferably the discharge orifice is housed in a chamber from which a dispense pipe delivers metal to the ladle or mold. The housing chamber is preferably supplied with an inert gas to prevent oxidation or contamination of the molten metal.

One object of this invention is to provide a metal delivery system having the foregoing features and which is capable of delivering accurate amounts of metal without the disadvantages of prior systems.

Another object is to provide a metal delivery system which is composed of a relatively few simple parts, is rugged and durable in use, and is capable of being inexpensively manufactured and assembled.

BRIEF DESCRIPTION OF THE DRAWINGS

Other objects, features and advantages of the invention will become more apparent as the following description proceeds, especially when considered with the accompanying drawings, wherein.

DETAILED DESCRIPTION OF THE PREFERRED EMBODIMENTS

Figures 1, 4, 5:
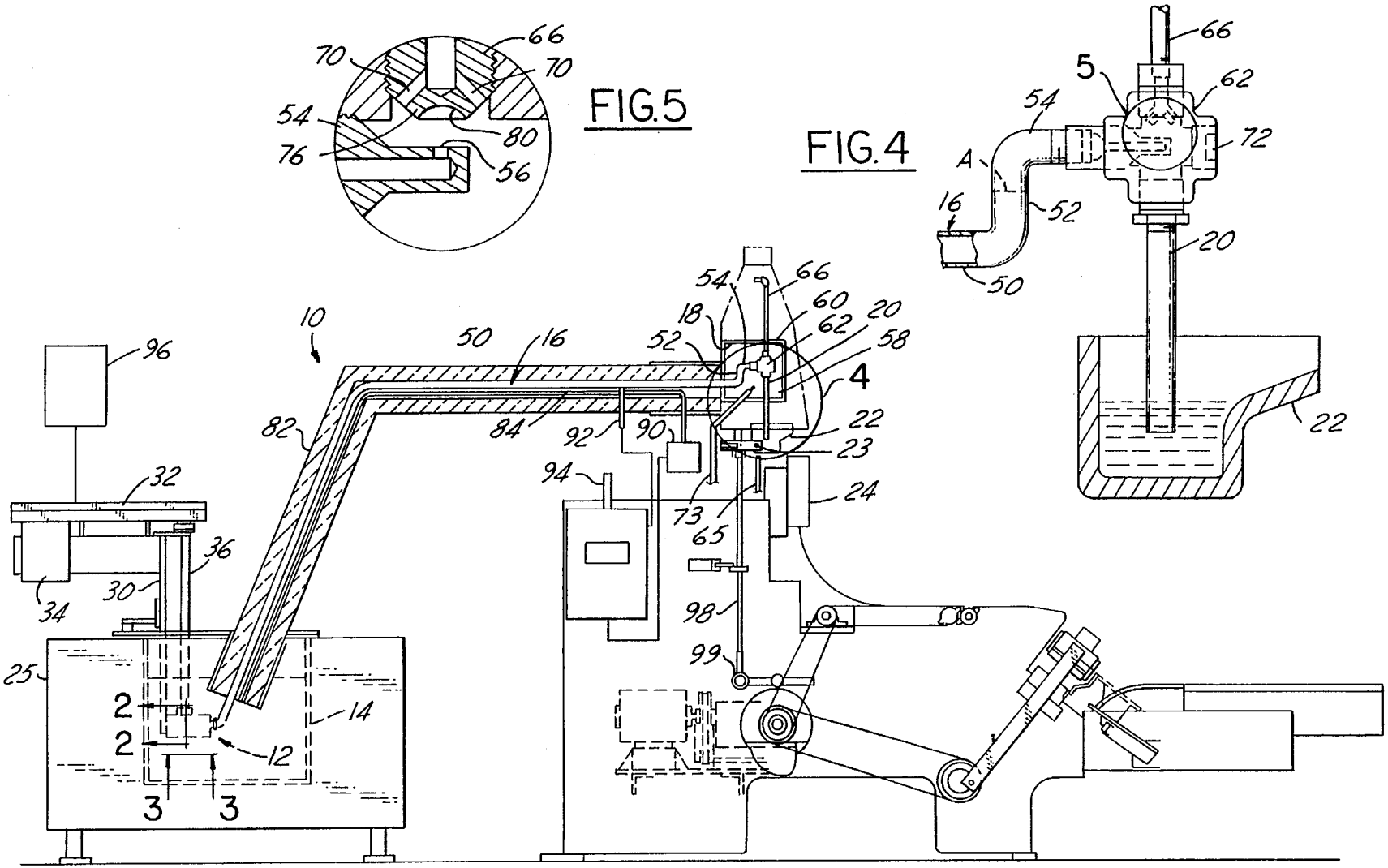
FIG. 1 is an elevational view with parts in section of a metal delivery system constructed in accordance with the invention.
FIG. 4 is an enlargement of a portion of the structure shown within the circle 4 in FIG. 1.
FIG. 5 is an enlargement of a portion of the structure shown within the circle 5 in FIG. 4.

Referring now more particularly to the drawings and especially to FIGS. 1–5, the metal delivery system 10 includes a pump 12 for forcing molten metal such as lead from a reservoir 14 through a delivery pipe 16, and a dispense pipe 20 to a ladle 22. The ladle is mounted on a pivot 23 so that it may be tilted to pour its contents into a mold 24.

The pump 12 is immersed in the molten metal in the reservoir 14 (FIG. 1). The reservoir is shown mounted in a furnace 25 to maintain the metal in the reservoir at an elevated temperature in a molten, flowable condition. When the metal is lead, the furnace temperature may be from 760° F. to 1000° F. The pump has a rotary impeller 26 mounted for rotation within a housing 28. The housing is mounted on the lower end of a vertical support bar 30 extending downwardly from a table 32. The impeller 26 is driven by a motor 34 mounted on table 32. More specifically, the motor 34 is operatively connected to the upper end of a vertical shaft 36. The impeller 26 is attached to the lower end of shaft 36. Operation of the motor 34 rotates the impeller 26 about its central axis.

The impeller 26 is formed with circumferentially spaced apart impeller arms 38 which extend generally radially outwardly from its central axis of rotation. The arms 38 are arcuately curved from the axial center of the impeller to their radially outer ends so that when the impeller is rotated in the direction of the arrow in FIG. 3, the radially outer ends of the arms trail the radially inner ends.

Figure 3:
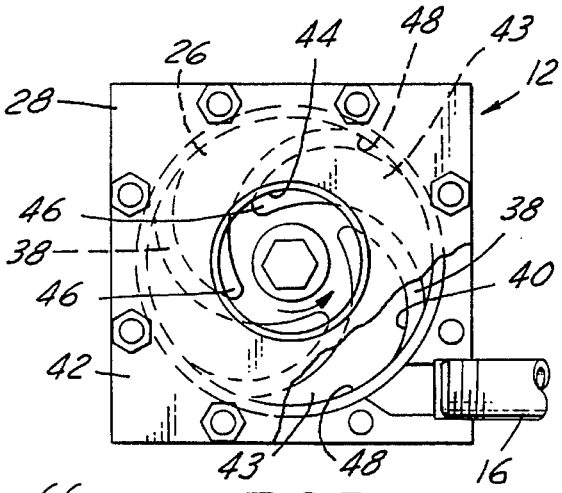
FIG. 3 is a fragmentary elevational view taken on the line 3—3 in FIG. 1.

The impeller arms have grooves 40 which cooperate with the bottom wall 42 of the housing 28 to provide fluid passages or channels 43 for the flow of molten metal in a radially outward direction when the impeller rotates in the direction of the arrow in FIG. 3. The central opening 44 in the wall 42 of housing 28 communicates with the inner ends 46 of the channels 43 so that when the impeller rotates, molten metal is drawn into the channels 43 and is forced out through the outer extremities 48 of the channels into the delivery pipe 16.

The delivery pipe 16 has one end opening into the side wall of the pump housing 28. Pipe 16 extends upwardly from the housing 28 at an angle and has a horizontal section 50 leading to a vertical section 52 that terminates in another horizontal section 54 provided with an upwardly opening orifice 56. The orifice 56 is much smaller in diameter than the inside diameter (ID) of pipe 16. For example, the diameter of the orifice may be 0.140 inches and the ID of pipe 16 may be 0.622 inches.

The horizontal section 50 of delivery pipe 16 extends into the chamber 58 of a heat containment box 60 so that the remote end portion of horizontal section 50, the vertical section 52 and horizontal section 54 are all enclosed and sealed within the chamber 58.

A hollow T-shaped housing 62 is secured on the end of the horizontal section 54 of delivery pipe 16 so that the orifice 56 is disposed within the hollow interior of the housing. The dispense pipe 20 is threaded into the bottom of the housing 62 and extends vertically downward towards the ladle 22. The dispense pipe 20 communicates with the hollow interior of the housing and transmits molten metal discharged from the orifice 56 to the ladle. The ladle is preferably heated by a gas heater 65 to keep the metal molten.

A gas inlet pipe 66 extends into the top of the housing 62 and has ports 70 in its lower end opening into the hollow interior of the housing to fill the interior of the housing with inert gas and thereby protect the molten metal from oxidation and/or contamination. The housing 62 has a clean-out port which is normally closed by a plug 72.

The heat containment box 60 encloses the remote end of the delivery pipe 16, the housing 62 and portions of the dispense pipe 20 and the gas inlet pipe 66, and is heated by a gas heater 73 to maintain the metal in a molten condition.

The lower end of the gas inlet pipe 66 has an integral head or cap 76 disposed in spaced relation above the orifice 56. The cap 76 has a downwardly concave deflecting surface 80 directly above orifice 56 so that molten metal discharged upwardly from the orifice strikes the deflecting surface and is directed downward toward the dispense pipe.

To insulate the delivery pipe 16, it is covered with insulation 82 from a point beneath the surface of the molten metal in the reservoir up to the heat containment box 60. The insulation 82 surrounds the delivery pipe 16 as well as an elongated heating element 84 which extends along substantially the full length of that portion of the delivery pipe which is protected by the insulation. The heating element 84 maintains the temperature of the delivery pipe 16 at a level sufficient to insure that the metal in the pipe remains molten and flowable. Specifically, a temperature control 88 together with a heater junction box 90 controls the temperature of the heating element 84. A thermocouple 92 transmits the actual temperature of the insulated delivery pipe 16 back to the temperature control 88. Electrical power is supplied to the temperature control by a power line 94.

The ladle 22 is mounted above the mold 24 so that from time to time it may be tipped or tilted about pivot 23 to pour molten metal into the mold 24.

The mold 24 may be used for the formation of any article. For example, the molten metal may be lead and the articles molded may be battery grids.

The operation of the pump motor 34 is controlled by a controller 96 which may receive speed, time period, and sequence signals from the controller for the main battery grid molding machine. The controller 96 includes a timer which controls the speed of the motor 34 and the time interval of operation of the motor at any desired speed. The mold may be of a type which is actuated by an air or hydraulic cylinder or by mechanical devices and opens and ejects a grid and then closes automatically. A mold for casting an automotive grid will cycle 10–20 times per minute depending on grid size and alloy. For industrial size grids, the cycle might be 3–12 times per minute, also depending on grid size and alloy. The casting machine usually has a motor which drives the grid transport conveyor by means of a rotary shaft which also turns a cam to actuate a tip mechanism for the ladle. The tip mechanism includes a rod 98 operated by a cam 99. This rotary shaft may have timing cams which can signal the controller 96 for the pump motor 34 that the ladle has poured.

The motor controller may be preset to operate the motor at two different speeds. The lower speed is such that it turns the pump impeller 26 only fast enough to maintain the molten metal at level A in FIG. 4 (pump stand-by speed). The lower motor speed could, for example, be such that it drives the impeller at 925 revolutions per minute (RPM). The higher speed could be such that it turns the pump impeller 26 at a faster rate sufficient to force the molten metal out through the orifice 56 (pump delivery speed). The higher motor speed could, for example, drive the pump impeller at 1137 RPM.

In operation, the motor 34 is run continuously at either the lower speed or the higher speed. When the motor runs at the lower speed and drives the pump at the stand-by speed, the delivery line is filled to the level A in FIG. 4 and the molten metal is maintained at that level. When it is desired to send a charge of molten metal to the ladle, the controller 96 for the motor receives a signal which immediately (in about 0.08 seconds) accelerates the motor to the higher speed and drives the pump at the higher pump delivery speed. Operation at the higher speed will force metal out of the orifice 56 to be deflected downward into the dispense pipe 20 by the deflecting surface 80 and will continue for the necessary time interval, which may run from about ½ second to 12 seconds in order to meter out a desired quantity of molten metal. The duration of time of operation of the pump at the higher speed can be varied depending on the amount of metal desired to be dispensed. At the end of this time period, the controller 96 immediately (in about 0.08 seconds) decelerates the motor and returns the pump back to the lower speed so that the discharge of molten metal immediately ceases and the molten metal returns to the level A in the delivery pipe in preparation for the next discharge cycle. In some cases, it may be desirable to stop the pump completely or even to reverse it before returning to the lower speed in order to shut off the flow through the orifice very quickly.

The motor 34 can be a variable speed motor of several different types. One satisfactory type is the Whedco Servo motor Model 3543-H manufactured by Whedco, Inc., of Ann Arbor, Mich. The horsepower (H.P.) can vary from 1 to 3 H.P. depending on the amount of metal to be pumped and the height of the delivery pipe above the reservoir. Various motor controllers are available such as a Whedco Intelligent Motor Controller Model 1MC-3141-2-B manufactured by Whedco, Inc., of Ann Arbor, Mich.

Figure 6:
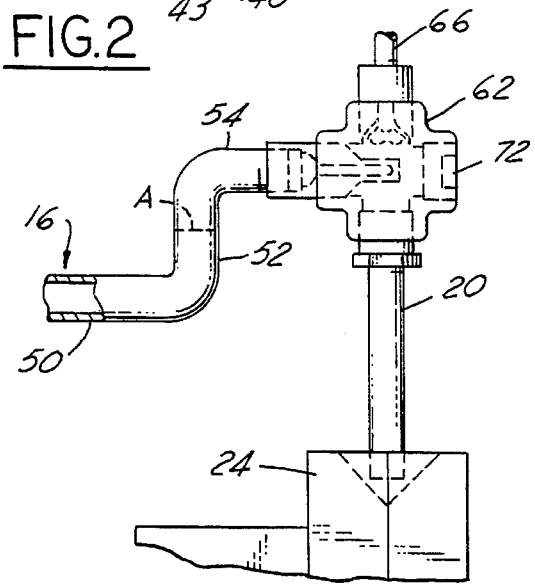
FIG. 6 is a view similar to FIG. 4 but shows the receiver into which the molten metal is dispensed as a mold instead of a ladle.

FIG. 6 shows a modification in which the ladle is eliminated and the dispense pipe 20 delivers molten metal directly into the mold 24.

Figure 7:
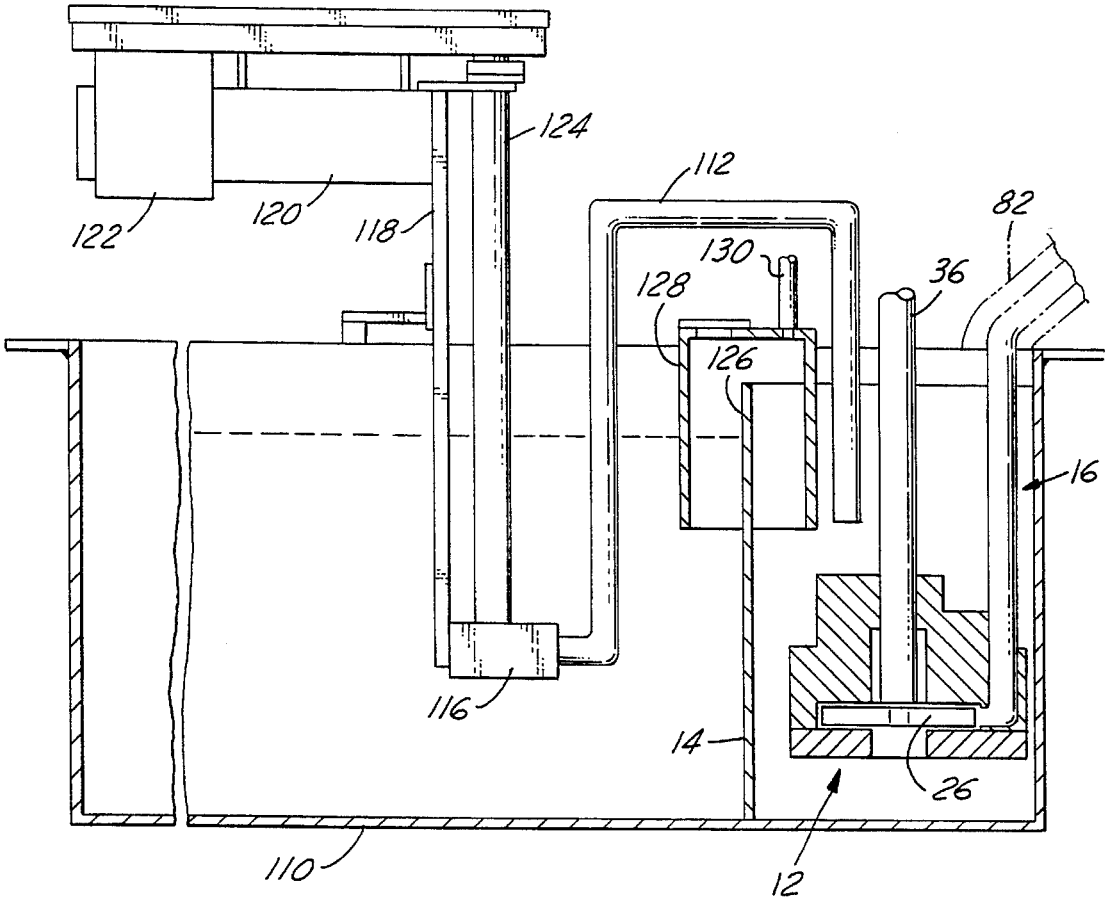
FIG. 7 is a sectional view showing a modification of a portion of the structure in FIG. 1.

FIG. 7 shows a further modification in which the reservoir 14, shown as an open top container, is placed in a tank 110 containing the molten metal. Both the reservoir and tank are disposed in a furnace (not shown) similar to the furnace 25 in FIG. 1 to retain the metal in molten condition. The molten metal in tank 110 is pumped into the reservoir 14 through a pipe 112 by a pump 116 submerged in the molten metal in tank 110. The pump 116 may be similar to the pump 12 in FIG. 1 and is mounted on the lower end of a support bar 118 which is anchored at the upper end to a table 120. A motor 122 mounted on table 120 rotates the shaft 124 to operate the pump 116. The motor 122 may be operated continuously if desired, to keep the reservoir full at all times. Overflow from the reservoir 14 returns to the tank 110 over the upper edge of a side wall of the reservoir which serves as a dam 126. A gas shield 128 of inverted, generally U-shape covers the dam. An inert gas enters the shield through pipe 130 and fills the space over the dam to prevent oxidation and/or contamination of any molten metal flowing over the dam. The system is otherwise like that of FIGS. 1–5 except that the portion of the delivery pipe 16 submerged in molten metal in the reservoir is vertical rather than inclined.

Figure 8:
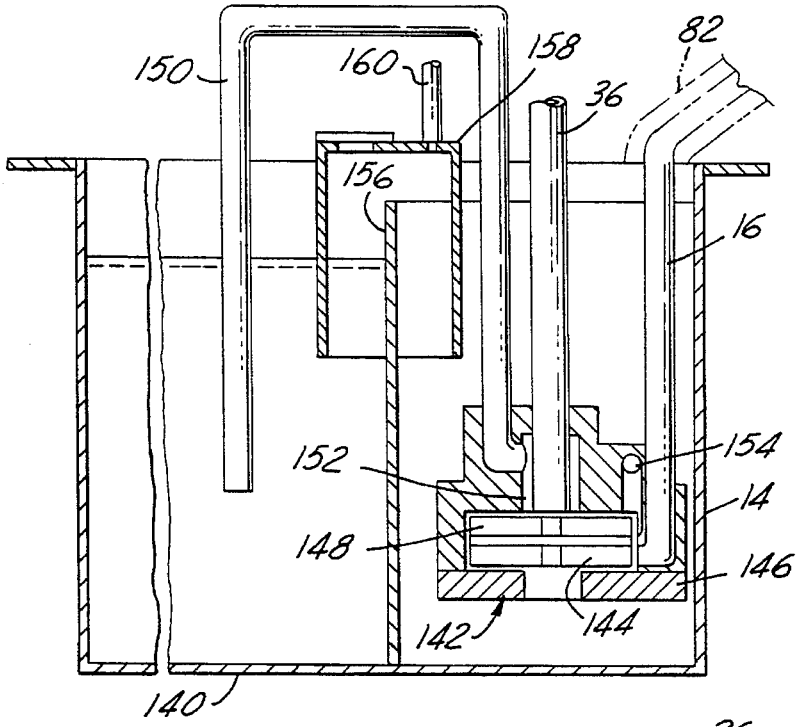
FIG. 8 is a sectional view of a further modification of a portion of the structure in FIG. 1.
Figure 2:
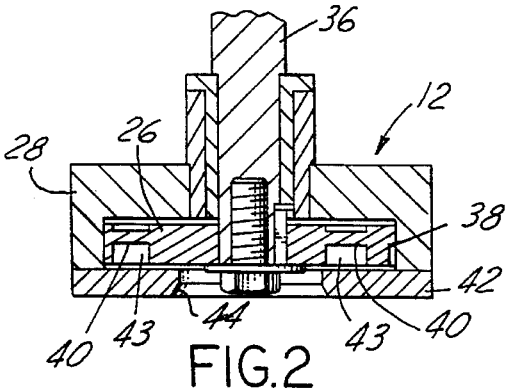
FIG. 2 is a fragmentary sectional view taken on the line 2—2 in FIG. 1.

FIG. 8 shows a further modification in which the open top container or reservoir t4 is placed in a tank 140 containing the molten metal. Both the reservoir and the tank are disposed in a furnace (not shown), similar to furnace 25 in FIG. 1 to retain the metal in a molten condition. The pump 142 is like the pump 12 in that it has a rotary impeller 144 mounted for rotation within a housing 146 to draw molten metal from the reservoir and force it out into the delivery pipe 16. However, the pump 142 has a second impeller 148 which rotates with impeller 144 and draws molten metal from the tank 140 through a pipe 150 into a chamber 152 in the pump housing 146 above impeller 148. Rotation of the impeller 148 forces the molten metal out of the housing 146 through port 154 to fill the reservoir. Overflow from the reservoir 14 returns to the tank 140 over the dam 156. A gas shield 158 of inverted, generally U-shape covers the dam. An inert gas enters the shield through pipe 160 and fills the space above the dam to prevent oxidation and/or contamination of any molten metal flowing over the dam. The system is otherwise like that in FIGS. 1–5 except that the portion of the delivery pipe 16 submerged in molten metal in the reservoir is vertical rather than inclined.

We claim:

1. Apparatus for delivering molten metal to a reservoir comprising:

a variable speed pump for molten metal a delivery pipe leading from said pump, said delivery pipe having an upwardly extending portion above said pump which leads to a discharge orifice from which molten metal may be intermittently discharged into said receiver, a variable speed motor for driving said pump, and a controller for said motor causing said motor to drive said pump essentially continuously and selectively at a first speed sufficient to raise molten metal to and maintain it at a level in said upwardly extending portion of said delivery pipe below said discharge orifice and at a second increased speed sufficient to force molten metal in said delivery pipe from said discharge orifice into the receiver, whereby molten metal is intermittently discharged from said discharge orifice when the pump is driven at the second increased speed.

2. Apparatus as defined in claim 1, wherein said controller includes a timer for regulating the duration of time of operation of said pump at said second speed and hence the amount of molten metal discharged from said orifice.

3. Apparatus as defined in claim 1, wherein said upwardly extending portion of said delivery pipe is disposed vertically.

4. Apparatus as defined in claim 1, and further comprising a housing above the receiver defining a chamber into which said orifice extends, and a dispense pipe leading downward from said chamber to the receiver.

5. Apparatus as defined in claim 1, wherein said pump is an impeller pump.

6. Apparatus as defined in claim 1, wherein said pump is a gear pump.

7. Apparatus as defined in claim 1, wherein said pump is a vane pump.

8. Apparatus as defined in claim 2, and further including a reservoir for molten metal, said variable speed pump being disposed in said reservoir and adapted to be immersed in molten metal therein, and said pump is an impeller pump.

9. Apparatus as defined in claim 8, wherein said pump has an impeller having a central axis and is supported for rotation about said central axis, said impeller having impeller arms extending generally radially outwardly from said central axis, said arms having passages for molten metal provided with inlets adjacent said central axis and outlets at their radially outer extremities.

10. Apparatus as defined in claim 2, and further comprising a housing above the receiver defining a chamber into which said orifice extends, and a dispense pipe leading downward from said chamber to the receiver, said orifice discharging upwardly, and a deflector above said orifice for deflecting molten metal discharged from said orifice downwardly into said dispense pipe.

11. Apparatus as defined in claim 10, wherein said upwardly extending portion of said delivery pipe is disposed vertically.

12. Apparatus as defined in claim 11, and further including a heater for heating said delivery pipe, and heat insulation covering said delivery pipe.

13. Apparatus as defined in claim 12, and further including a heat containment box enclosing said housing and at least portions of said delivery pipe and said dispense pipe.

14. Apparatus as defined in claim 13, and further including means for supplying an inert gas to said chamber to protect the molten metal from at least one of oxidation and contamination.

15. Apparatus as defined in claim 14, wherein said reservoir is an open top container disposed in a tank containing a reserve supply of the molten metal, piping for molten metal leading from said tank to said reservoir, and a power device for moving molten metal through said piping to said reservoir, said reservoir having an upper edge providing a dam to prevent overfilling of said reservoir and permit return of excess molten metal from said reservoir to said tank.

16. Apparatus as defined in claim 15, wherein said power device comprises a pump submerged in the molten metal in said tank.

17. Apparatus as defined in claim 15 wherein said power device comprises an impeller in said variable speed pump.

18. A method of delivering molten metal to a receiver through a delivery pipe having an upwardly extending section leading to a discharge orifice, comprising providing a variable speed pump for forcing molten metal through said delivery pipe, operating the pump essentially continuously, operating said pump at a first speed sufficient to raise molten metal to a level in said upwardly extending section of said delivery pipe below said discharge orifice and to maintain the molten metal at said level before discharge of molten metal from said discharge orifice, and thereafter operating said pump at a second speed, greater than the first speed and sufficient to force molten metal above said level and discharge it from said orifice.

19. The method as defined in claim 18 in which a timer controls the length of time of operation of the pump at the second speed to control the amount of molten metal discharged from the orifice.

20. The method as defined in claim 18 wherein the upwardly extending portion of the delivery pipe is disposed vertically.

21. The method as defined in claim 18 wherein the orifice discharges metal into a chamber and the metal passes from the chamber through a dispense tube to the receiver.

22. The method as defined in claim 18 wherein the pump is an impeller pump.

23. The method as defined in claim 18 wherein the pump is a gear pump.

24. The method as defined in claim 18 wherein the pump is a vane pump.

25. The method as defined in claim 18 wherein molten metal is discharged from the orifice generally upwardly into a chamber and the molten metal passes from the chamber generally downwardly through a dispense pipe to the receiver.

26. The method as defined in claim 25 which also comprises applying an inert gas to the chamber to protect the molten metal from at least one of oxidation and contamination.

27. The method as defined in claim 18 wherein molten metal is discharged from the orifice generally upwardly into a chamber and is deflected generally downwardly and passes through a dispense pipe to the receiver.

28. The method as defined in claim 18 wherein the pump is operated alternately at the first speed and the second speed to intermittently discharge molten metal from the orifice whenever the pump is operating at the second speed and to quickly cease the discharge of molten metal from the orifice when the speed rapidly changes from the second speed to the first speed.

29. The method as defined in claim 18 wherein the pump is immersed in molten metal received in an open top container which is disposed in a tank containing a reserve supply of molten metal with the container having a dam adjacent the top of the container to prevent overfilling of the container and permit the return of any excess molten metal from the container to the tank.

30. The method as defined in claim 29 which also comprises pumping sufficient molten metal from the tank into the container to insure that the pump remains immersed in molten metal while operating.

31. The method as defined in claim 30 which also comprises disposing the dam in a chamber through which excess molten metal can flow from the container to the tank and supplying an inert gas to the chamber while the pump is operating to protect the molten metal from at least one of oxidation and contamination.

* * * * *